US008400291B2

(12) United States Patent
Sugiura

(10) Patent No.: US 8,400,291 B2
(45) Date of Patent: Mar. 19, 2013

(54) INFORMATION DISPLAY APPARATUS AND COMPUTER READABLE MEDIUM HAVING INFORMATION DISPLAY PROGRAM

(75) Inventor: Masatoshi Sugiura, Nishio (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 387 days.

(21) Appl. No.: 12/705,064

(22) Filed: Feb. 12, 2010

(65) Prior Publication Data

US 2010/0201510 A1 Aug. 12, 2010

(30) Foreign Application Priority Data

Feb. 12, 2009 (JP) ..... 2009-030532

(51) Int. Cl.
*G08B 23/00* (2006.01)

(52) U.S. Cl. ..... 340/501; 715/867; 345/901

(58) Field of Classification Search ..... 340/501, 340/525, 815.4; 345/87, 89, 90, 101, 207, 345/218, 418, 690, 1.2, 3.1, 901, 211, 97, 345/107, 204; 715/867, 747, 745, 764, 765, 715/767; 250/205; 359/296
See application file for complete search history.

(56) References Cited

U.S. PATENT DOCUMENTS

| | | | | |
|---|---|---|---|---|
| 6,392,786 | B1 | 5/2002 | Albert | |
| 7,507,943 | B2 * | 3/2009 | Ichikawa et al. | 250/205 |
| 7,538,757 | B2 * | 5/2009 | Zhou et al. | 345/107 |
| 7,545,398 | B2 * | 6/2009 | Sawada | 345/211 |
| 2003/0137717 | A1 | 7/2003 | Albert et al. | |
| 2005/0060670 | A1 * | 3/2005 | Inui et al. | 715/867 |
| 2005/0273349 | A1 * | 12/2005 | Abedi et al. | 705/1 |
| 2008/0150971 | A1 * | 6/2008 | Kienhoefer | 345/690 |

FOREIGN PATENT DOCUMENTS

| | | | |
|---|---|---|---|
| JP | 2002-526812 | T | 8/2002 |
| JP | 2003-504666 | T | 2/2003 |
| WO | 0020922 | A1 | 4/2000 |
| WO | 0102899 | A2 | 1/2001 |

* cited by examiner

*Primary Examiner* — Anh V La
(74) *Attorney, Agent, or Firm* — Baker Botts L.L.P.

(57) ABSTRACT

An information display apparatus includes a display unit including a non-volatile display medium. The information display apparatus further includes: a temperature detecting unit configured to detect a display unit temperature which is temperature of the display unit; a temperature determining unit configured to determine whether the display unit temperature is outside of a set temperature range which is predetermined based on characteristics of the display unit; and a display control unit configured to perform on the display unit a burn prevention display which is predetermined based on the characteristics, when the display unit temperature is outside of the set temperature range.

12 Claims, 5 Drawing Sheets

INFORMATION DISPLAY APPARATUS AND COMPUTER READABLE MEDIUM HAVING INFORMATION DISPLAY PROGRAM

CROSS-REFERENCE TO RELATED APPLICATIONS

This application claims priority from Japanese Patent Application No. 2009-030532 filed on Feb. 12, 2009, the entire contents of which are incorporated herein by reference.

TECHNICAL FIELD

The present invention relates to an information display apparatus and an information display program, and more specifically, to an information display apparatus which includes a display unit using a non-volatile display medium and a program for the information display apparatus.

BACKGROUND

Recently, an information display apparatus which includes a display unit using a non-volatile display medium have been developed. An information display apparatus which includes a display unit using a electrophoretic display medium and which has a promising future due to an electric power saving ability because of an ability to maintain displayed contents without periodical (successive) driving electric power supply.

Herein, the electrophoretic display medium includes microcapsules having a diameter of about 40 micrometer containing a fluid such as oil, white color particles and black color particles, and individually moves the white color particles and black color particles by an electric field, to thereby perform apparent white color displays and black color displays. There is related art for the information display apparatus which includes the display unit using such electrophoretic display medium.

Meanwhile, in other types of the information display apparatuses such as a liquid crystal panel and a plasma display panel, a so-called "screen burn" problem is known. Screen burn refers to a phenomenon that in the case that the same image is continuously displayed for a long time, the original image is dimly displayed as a residual image on a display unit even after the original image is changed into another image, thereby causing deterioration in visibility in the display unit. Further, a variety of methods for preventing burn has been developed.

SUMMARY

The inventor of the invention, even in the non-volatile electrophoretic display medium, experimentally have found out that the burn phenomenon is generated in the cases that an image is left as it is for a predetermined time at a high temperature while the image is being displayed. However, there is no disclosure or suggestion for solving the screen burn problems in the related art.

The present invention was made in view of the above circumstances, and an object of some aspects of the invention is to provide an information display apparatus and a program for the information display apparatus which can maintain visibility with power saving ability and has high applicability even under the circumstances that the above described burn is likely to be generated.

According to an aspect of the invention, there is provided an information display apparatus comprising: a display unit including a non-volatile display medium; a temperature detecting unit configured to detect a display unit temperature which is temperature of the display unit; a temperature determining unit configured to determine whether the display unit temperature is outside of a set temperature range which is predetermined based on characteristics of the display unit; and a display control unit configured to perform on the display unit a burn prevention display which is predetermined based on the characteristics, when the display unit temperature is outside of the set temperature range.

According to another aspect of the invention, there is provided a computer readable medium having an information display program for an information display device comprising a display unit including a non-volatile display medium, said program being stored thereon, readable by a computer, and when executed by the computer, causing the computer to perform operations comprising: detecting a display unit temperature which is temperature of the display unit; determining whether the display unit temperature is outside of a set temperature range which is predetermined based on characteristics of the display unit; and performing on the display unit a burn prevention display which is predetermined based on the characteristics, when the display unit temperature is outside of the set temperature range.

BRIEF DESCRIPTION OF DRAWINGS

FIGS. 1A and 1B illustrate schematic configurations of an information processing system according to an embodiment of the invention, in which FIG. 1A is a block diagram illustrating an overall configuration of the information processing system; and FIG. 1B is a front view of a display apparatus included in the information processing system;

FIGS. 4A to 4F are flowcharts illustrating details of the operation of the display apparatus according to the embodiment, in which FIG. 4A is a flowchart illustrating a power saving operation at power off; FIG. 4B is a flowchart illustrating a periodical observation operation; FIG. 4C is a flowchart illustrating a temperature monitoring operation; FIG. 4D is a flowchart illustrating a power-off operation; FIG. 4E is a flowchart illustrating a power saving operation on standby; and FIG. 4F is a flowchart illustrating a time measurement task operation.

DESCRIPTION

Next, embodiments of the invention will be described with reference to the accompanying drawings. The embodiment shows an exemplified information processing system which includes a personal computer and a portable display apparatus, for example, using an electrophoretic display medium, which is connected to the personal computer. However, the present invention should not be construed as being limited thereto.

Firstly, a schematic configuration of the information processing system according to the embodiment will be described with reference to FIG. 1A.

Figure 1A:
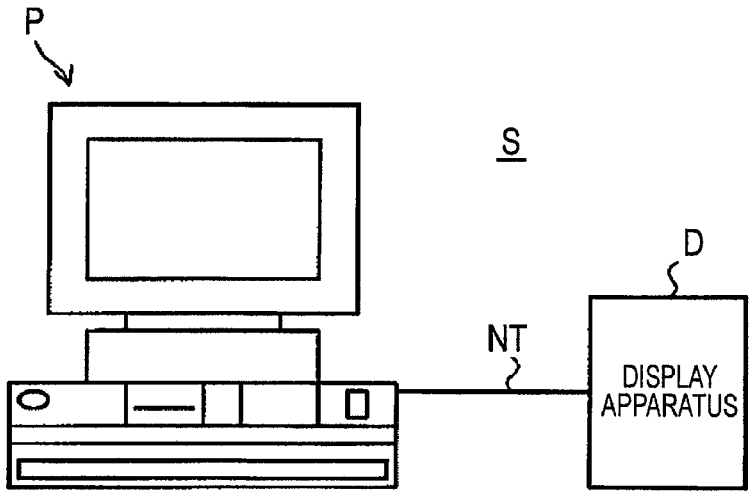

As shown in FIG. 1A, an information processing system S according to the embodiment includes the personal computer P and the display apparatus D, which are connected to each other through a network NT, for example, according to a USB (Universal Serial Bus) standard or a LAN (Local Area Network) standard. Data communication between the personal computer P and the display apparatus D may be performed using a memory card to be described later.

In this configuration, information on a document or the like which is a display target generated in the personal computer P is output to the display apparatus D through the network NT to be displayed on the display apparatus D.

Next, the display apparatus D according to the embodiment will be described with reference to FIGS. 1B and 2.

Figure 1B:
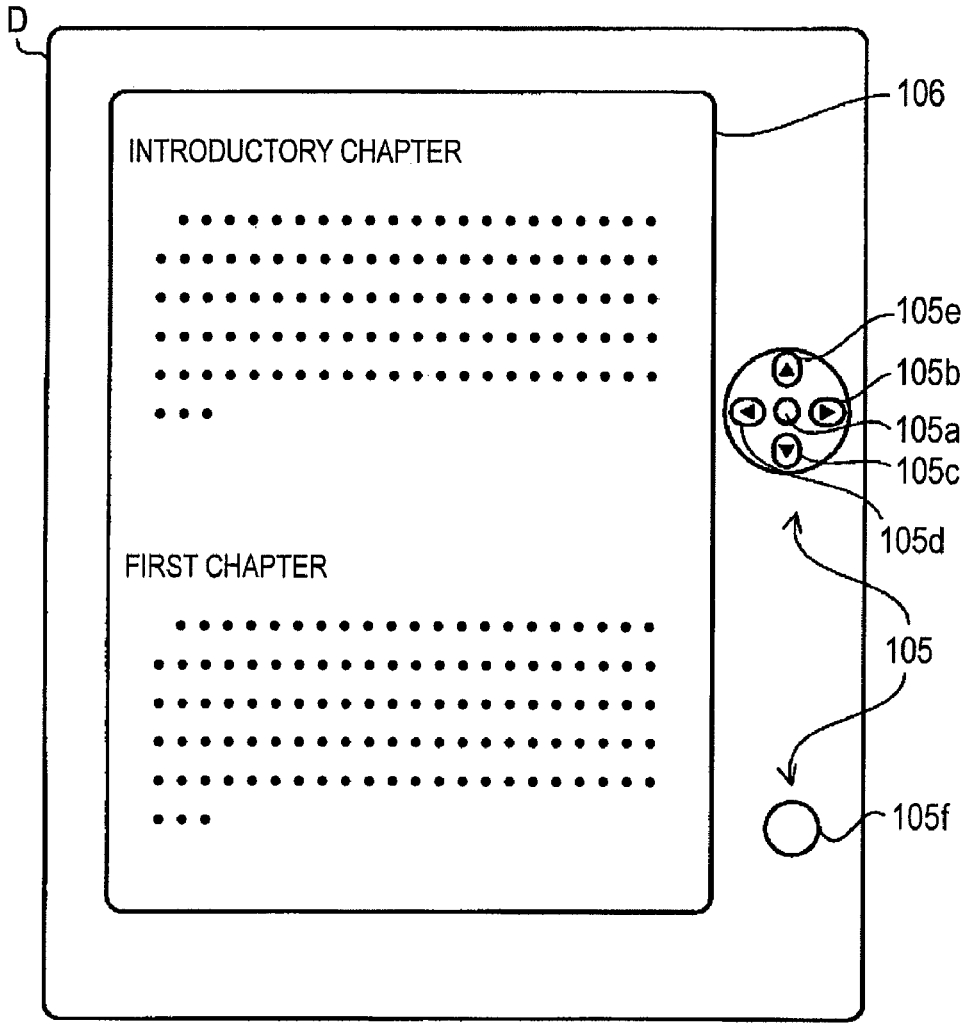
Figure 2:
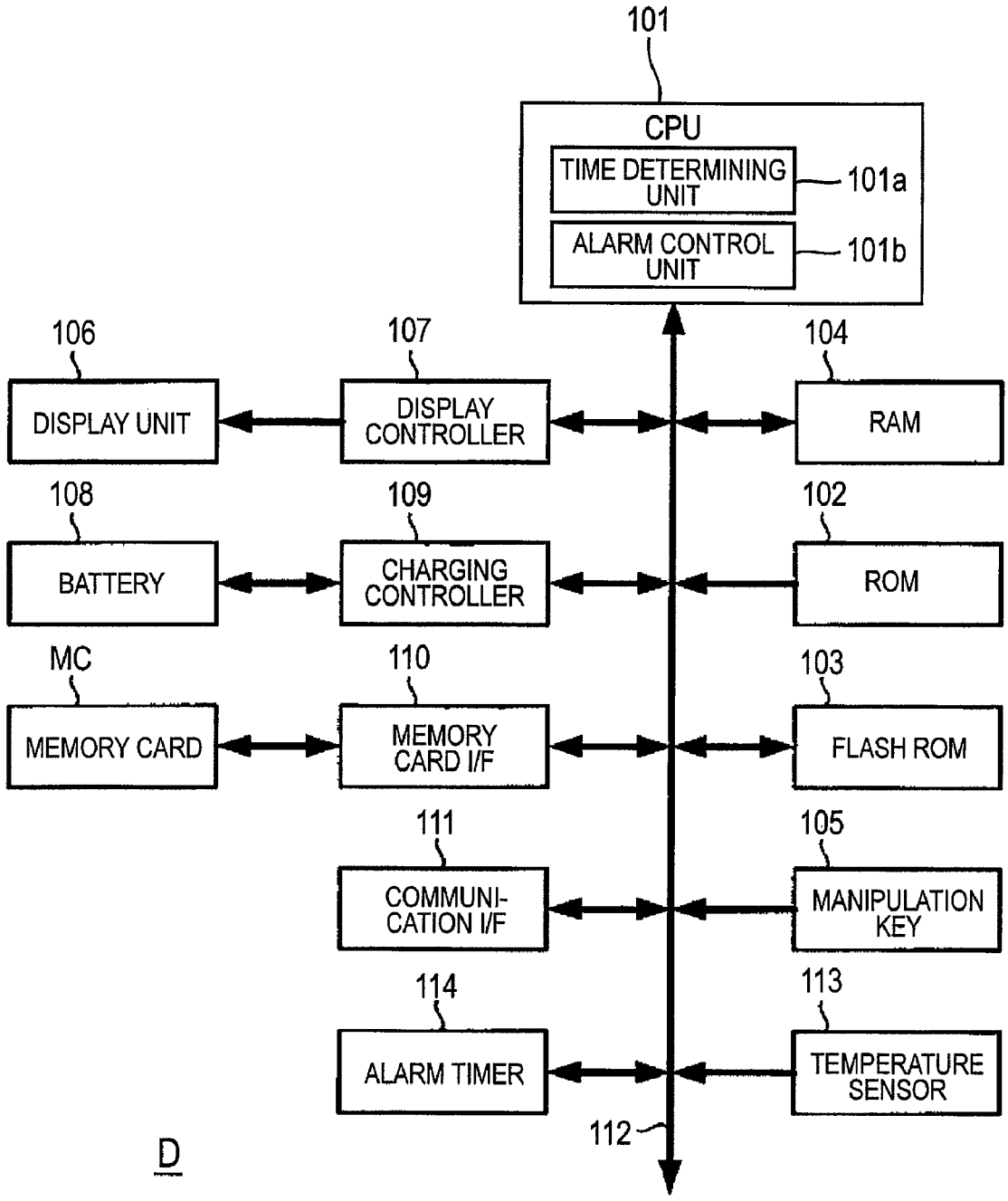
FIG. 2 is a block diagram illustrating a schematic configuration of the display apparatus according to the embodiment.

As shown in FIGS. 1B and 2, the display apparatus D according to the embodiment includes a CPU (Central Processing Unit) 101, a ROM (Read Only Memory) 102, a flash ROM 103, manipulation keys 105, a display unit 106, and a display controller 107. The CPU 101 is an example of a temperature determining unit and a display control unit, and includes an alarm control unit 101*b* configured to control the display apparatus D as a whole and performs an operation of the embodiment to be described later, and a time determining unit 101*a* as an example of a time determining unit. The ROM 102 stores a firmware or the like. The flash ROM 103 is a non-volatile memory, and stores a variety of control programs for performing an operation as the display apparatus D according to the embodiment, data such as user setting, information displayed on the display unit 106 such as document information corresponding to a document, etc. The RAM 104 temporarily stores data required for a control process of the CPU 101. The manipulation keys 105 includes a cursor key to be described later, a determination key and a power switch, and provides commands from a user to the CPU 101 as command information. The display unit 106 includes a display panel, for example, the electrophoretic display panel, and is an example of a display unit configured to display on a screen thereof a document or the like corresponding to information transmitted from the personal computer P. The display controller 107 is an example of a display control unit and configured to control display on the display unit 106 based on commands from the CPU 101.

The manipulation keys 105 specifically includes an up key 105*e* and a down key 105*c* which are manipulated for moving (scrolling), a document displayed on the display unit 106, for example, vertically upwards or vertically downwards; a previous key 105*d* and a next key 105*b* which are manipulated for moving the document to a previous page and a next page for every page, respectively; the determination key 105*a* which is manipulated for determining results of various manipulations; and the power switch 105*f*. Herein, the cursor key includes the up key 105*e*, the down key 105*c*, the previous key 105*d* and the next key 105*b*.

The display apparatus D further includes a battery 108, a charging controller 109, a memory card I/F (Interface) 110, a communication I/F 111, a temperature sensor 113 and an alarm timer 114. The battery 108 includes, for example, a lithium ion battery or the like. The charging controller 109 controls charging for the battery 108. The memory card I/F 110 includes a memory card drive or the like and performs data writing and reading for a memory card MC which is inserted to the memory card drive based on a command from the CPU 101. The communication I/F 111 performs an interface process for transmitting and receiving data by connecting the display apparatus D with the personal computer P through the network NT. The temperature sensor 113 is as an example of a temperature detecting unit, and detects temperature of the display unit 106 (hereinafter, referred to as a display unit temperature) and outputs the detection result to the CPU 101. The temperature sensor 113 may detect: a temperature of an inside of the display unit 106; a temperature of a surface of the display unit 106; or a temperature of an outside (periphery) of the display unit 106. The alarm timer 114 is an example of a timer unit, and performs an interrupt task at the elapse of a predetermined time by an operation to be described later. The CPU 101 is connected through a bus 112 to the ROM 102, the flash ROM 103, the RAM 104, the manipulation keys 105, the display controller 107, the charging controller 109, the memory card I/F 110, the communication I/F 111, the temperature sensor 113, the alarm timer 114.

Next, an operation of the display apparatus D according to the embodiment will be described with reference to FIGS. 3 and 4A to 4F.

Figure 3:
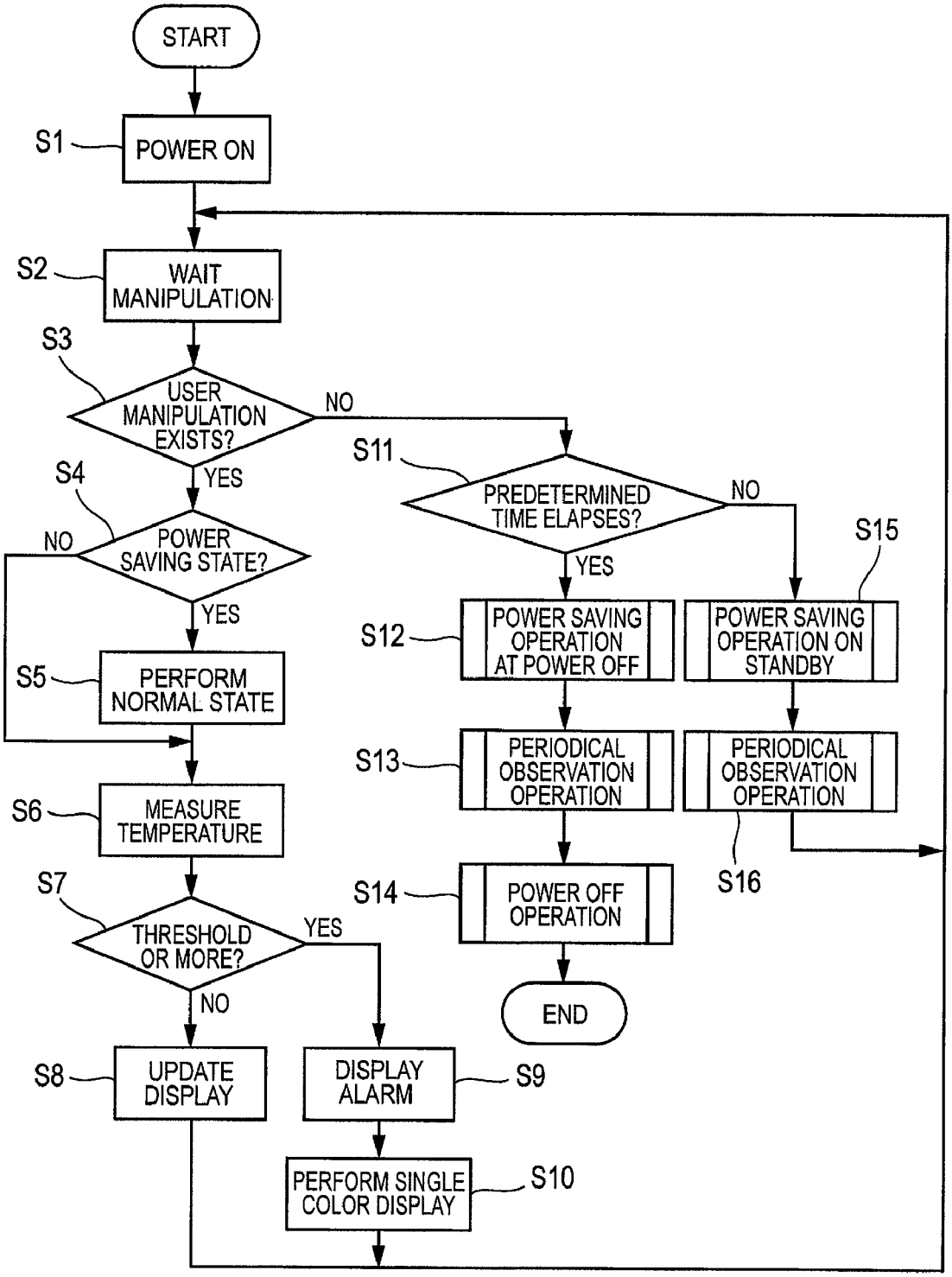
FIG. 3 is a flowchart illustrating an overall operation in the display apparatus according to the embodiment.

According to the operation of the display apparatus D of the embodiment, as shown in FIG. 3, if the power switch 105*f* is manipulated to supply power for the display apparatus D itself (step S1), the CPU 101 waits for a manipulation by a user using the manipulation keys 105 (steps S2 and S3).

Then, if a display manipulation, for example, for a document or the like using the manipulation keys 105 is performed (step S3: YES), the CPU 101 confirms whether the display apparatus D is currently in a power saving state (step S4). The power saving state refers to a state that the CPU 101 is in a state waiting for the manipulation of the manipulation keys 105, a function of the ROM 102 is stopped and the RAM 104 is in the power saving state, and thus, power consumption of the display apparatus D is suppressed to a minimum.

Further, as a result of the confirmation in step S4, when the display apparatus D is not in the power saving state (step S4: NO), the CPU 101 performs an operation of step S6 to be described later. Meanwhile, as a result of the confirmation in step S4, when the display apparatus D is in the power saving state, the CPU 101 moves the display apparatus D to a normal operation state in which display of a document or the like is normally performed (step S5).

Next, the CPU 101 detects the display unit temperature based on the detection result from the temperature sensor 113 (step S6), and confirms whether the detected value is equal to or more than a predetermined threshold temperature for the display unit 106 (step S7). Herein, the threshold temperature refers to a threshold temperature which is experimentally confirmed in advance, in which a burn phenomenon can be confirmed in an electrophoretic display employed as the display unit 106.

As a result of the confirmation in step S7, when the display unit temperature is below the threshold temperature (step S7: NO), the CPU 101 controls the display controller 107, so that the display on the display unit 106 is updated based on the manipulation (see step S3) by the manipulation keys 105, as the normal operation state in step S5 (step S8). Accordingly, a browsing operation for a document of the display apparatus D is performed. Then, the CPU 101 returns the procedure to the operation of step S2.

Meanwhile, as a result of the confirmation in step S7, when the display unit temperature is the threshold temperature or more (step S7: YES), the alarm control unit 101*b* of the CPU 101 controls the display controller 107 so that alarm information for performing a burn prevention display is displayed on the display unit 106 (step S9). As a specific example of the alarm information, a message (characters) "performing the burn prevention display" is displayed on the display unit 106.

Further, the CPU 101 controls the display controller 107 to perform the whole white color display for burn prevention as the burn prevention display on the display unit 106, after displaying the alarm information in step S9 (step S10).

Herein, it is preferable that any specific information (image) as the burn prevention display in step S10, which is to be displayed on the display unit 106, is experimentally predetermined based on display principles or display methods of a non-volatile display medium which is used in the display unit 106. More specifically, for example, when the display unit 106 includes the electrophoretic display medium as the non-volatile display medium according to the embodiment, in view of burn prevention, it is preferable that a color corresponding to particles which more easily migrate is a display color for burn prevention based on migration of white color particles or black color particles which are enclosed in microcapsules. In other words, a color opposite to that of particles having a low migration characteristic may be used as the display color for burn prevention. In any case, it is preferable that the display color for burn prevention is experimentally determined, in consideration of a supposed cause of burn, based on a supposed highest temperature as the display unit temperature of the display apparatus D, material of particles which migrate in the microcapsule, the size of the microcapsule, attributes of information which is frequently displayed on the display unit 106 (information indicating that a white color display is frequently performed, information indicating that a black color display is frequently performed, or the like), and the like.

In the case that color particles other than the white color particles or the black color particles are enclosed in the microcapsule, that is, in the case that the color display on the display unit 106 can be performed, the burn prevention display may be performed using any one of the displayable colors. In addition, as the burn prevention display, in the case of the electrophoretic display, a single color image may be displayed as described above or color particles which are enclosed in the microcapsule may be temporarily agitated in the microcapsule and then, may be left as they are.

After the whole white color display for burn prevention is performed, the CPU 101 returns the procedure to the operation of step S2.

Meanwhile, as a result of the confirmation in step S3, a manipulation is not performed by a user using the manipulation keys 105 (step S3: NO), the CPU 101 confirms in the alarm timer 114 whether the predetermined time, which is measured in time in a time measurement task to be described later, has elapsed (step S11).

Thus, when the predetermined time has not elapsed (step S11: NO), the CPU 101 performs a power saving operation on standby to be described later (step S15), performs a periodical observation operation to be described later (step S16), and then performs the operation in the step S2.

Further, as a result of the confirmation in step S11, when the predetermined time has elapsed (step S11: YES), the CPU 101 performs a power saving operation when turning off the power to be described later (step S12), performs a periodical observation operation which is the same as the operation of step S16 (step S13), and then performs an operation for turning off the power to be described later (step S14), to thereby terminate the operation as the display apparatus D.

Next, details of the power saving operation when turning off the power in step S12 of FIG. 3 will be specifically described with reference to FIG. 4A.

Figure 4A:
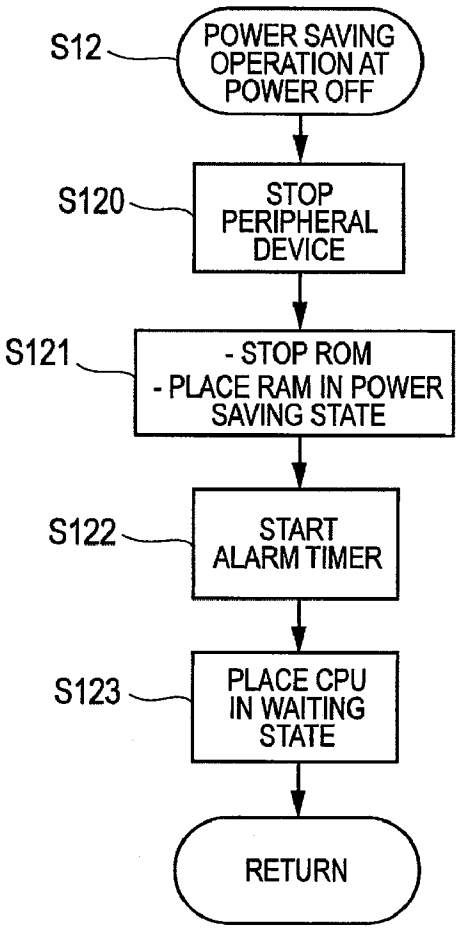

As shown in FIG. 4A, as the power saving operation when turning off the power, the CPU 101 firstly cuts off power supply for the components (see FIG. 2) of the display apparatus D other than the CPU 101, the ROM 102 and the RAM 104 (step S120). Then, the CPU 101 cuts off power supply for the ROM 102, changes the RAM 104 into a power saving state (step S121), and then drives the alarm timer 114 (step S122). Further, the CPU 101 makes the CPU 101 itself enter into a state of waiting for interrupt request from the alarm timer 114 and a state of waiting for input manipulation from the manipulation keys 105 (step S123), and then performs the operation in step S13 shown in FIG. 3.

Next, details of the periodical observation operation in step S13 in FIG. 3 will be specifically described with reference to FIG. 4B.

Figure 4B:
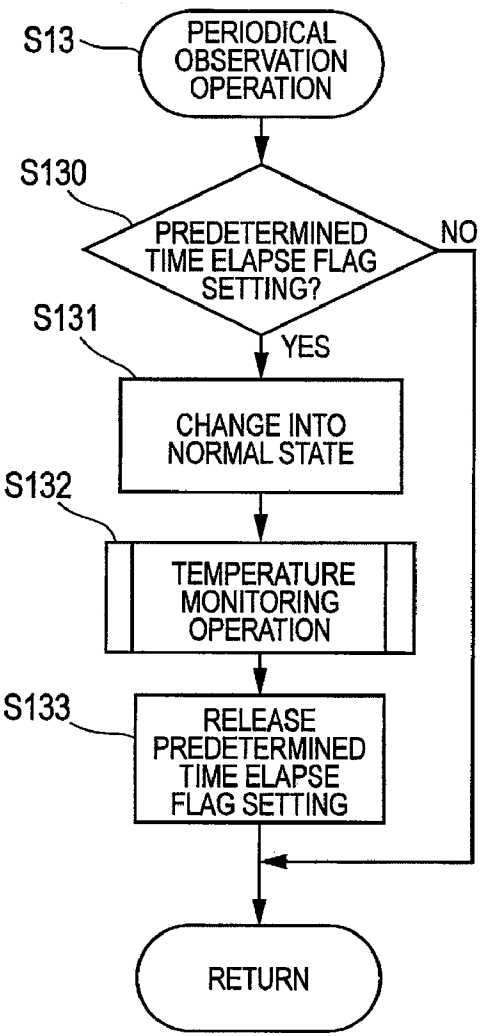

As shown in FIG. 4B, as the periodical observation operation, firstly, the time determining unit 101*a* of the CPU 101 confirms whether a predetermined time elapse flag (not shown) in the CPU 101 is set (for example, whether the value is "TRUE") (step S130). The predetermined time elapse flag is set or released by a time measurement task to be described later. Accordingly, in the case that the predetermined time elapse flag is set (step S130: YES), the CPU 101 supplies power for each component to return the entire display apparatus D to the normal operation state (step S131), and then performs a temperature monitoring operation to be described later (step S132). Then, the time determining unit 101*a* of the CPU 101 releases the setting of the predetermined time elapse flag (step S133), and performs an operation in step S14 in FIG. 3. As the operation in step S133, for example, the CPU 101 performs an operation that a value of the predetermined time elapse flag is "FALSE".

Next, details of the temperature monitoring operation in step S132 in FIG. 4B will be specifically described with reference to FIG. 4C.

Figure 4C:
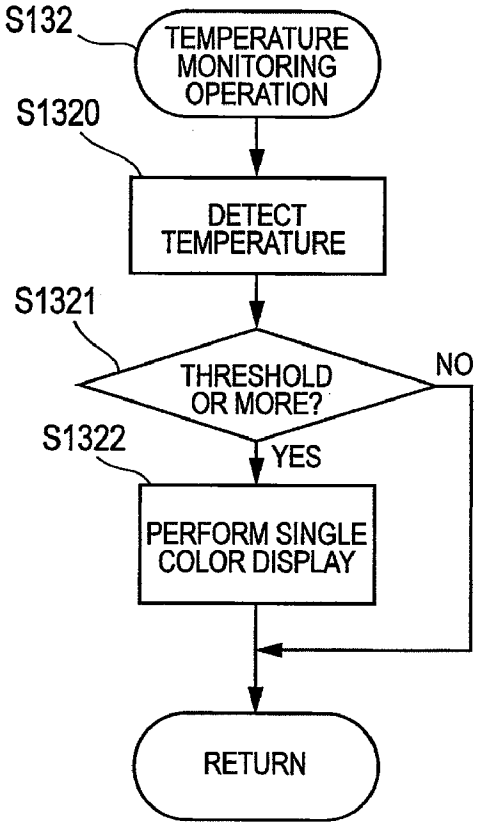

As shown in FIG. 4C, as the temperature monitoring operation, the CPU 101 firstly obtains the detection result from the temperature sensor 113 (step S1320), and confirms whether the detection result is equal to or more than the threshold temperature (step S1321, see step S7 in FIG. 3). Thus, in the case that the detection result is below the threshold temperature (step S1320: NO), the CPU 101 performs the operation S133 in FIG. 4B. Meanwhile, as a result of the confirmation in step S1320, in the case that the detection result is equal to or more than the threshold temperature (step S1320: YES), the CPU 101 controls the display controller 107 so that the same display as the burn prevention display in step S10 in FIG. 3 is performed on the display unit 106 (step S1322), and then, the CPU 101 performs the operation in step S133 in FIG. 4B.

Next, details of the operation for turning off the power in step S14 in FIG. 3 will be specifically described with reference to FIG. 4D.

Figure 4F:
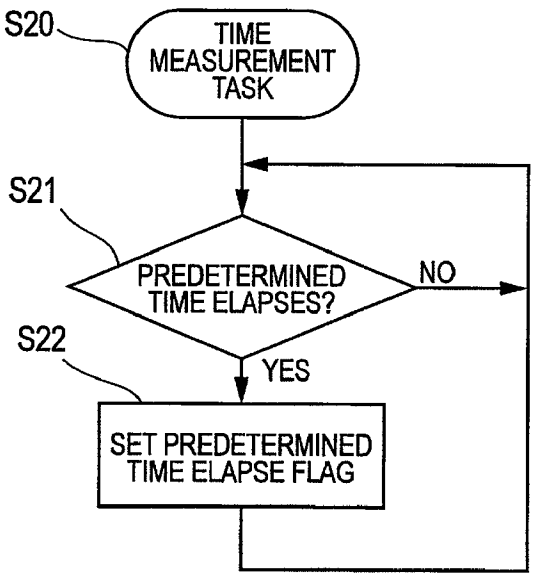
Figure 4E:
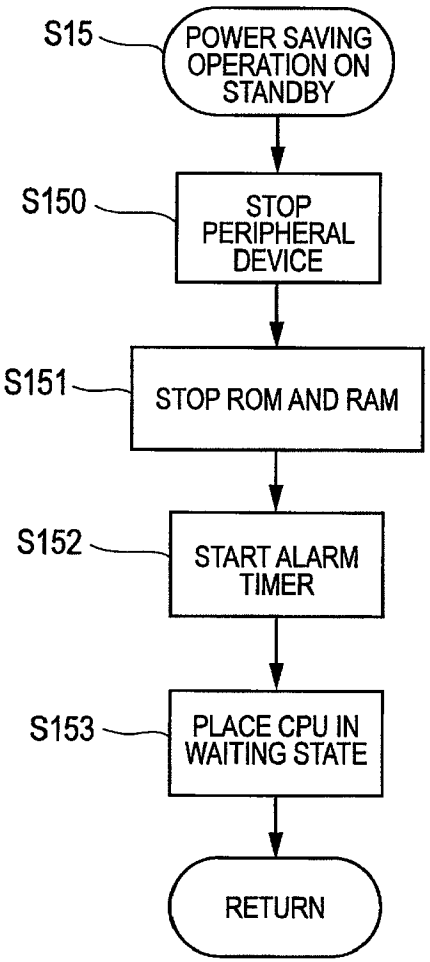
Figure 4D:
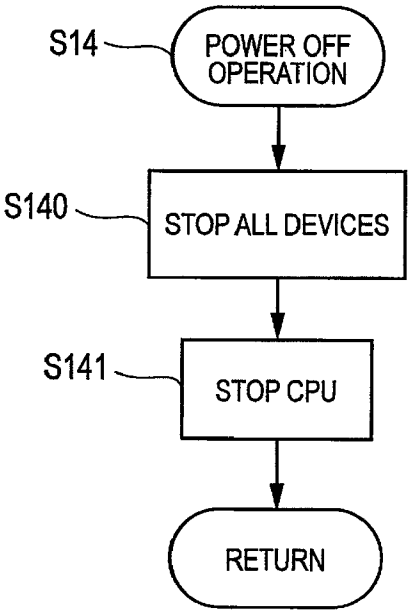

As shown in FIG. 4D, as the operation for turning off the power, the CPU 101 cuts off power supply to the all components (see FIG. 2) of the display apparatus D other than the CPU 101 (step S140). Then, the CPU 101 stops the CPU 101 itself (step S141), and then, the operation of the display apparatus D is terminated.

Next, details of the power saving operation on standby in step S15 of FIG. 3 will be specifically described with reference to FIG. 4E.

As shown in FIG. 4E, as the power saving operation on standby, the CPU 101 firstly cuts off power supply to the components (see FIG. 2) of the display apparatus D other than the CPU 101, the ROM 102, the RAM 104 (step S150). Next, the CPU 101 again cuts off power supply to the ROM 102 and the RAM 104 (step S151), and then, again drives the alarm timer 114 (step S152). The CPU 101 makes the CPU 101 itself enter into the state of waiting for interrupt request from the alarm timer 114 (step S153), and performs the operation in step S13 in FIG. 3.

Finally, the time measurement task (step S20) which is normally performed in the alarm timer 114 will be specifically described with reference to FIG. 4F.

As shown in FIG. 4F, as the time measurement task, the time determining unit 101*a* of the CPU 101 firstly confirms the time measurement interruption in the alarm timer 114 which is being driven (see step S122 in FIG. 4A or step S152 in FIG. 4E), and confirms whether the predetermined time has elapsed in the time measurement interruption (step S21). Thus, in the case that the time measurement is below the predetermined time (step S21: NO), the time determining unit 101*a* allows the alarm timer 114 to maintain the time measurement. Meanwhile, as a result of the confirmation in step S21, when the predetermined time elapsed the measured time in the alarm timer 114 (step S21: YES), the time determining unit 101*a* sets the predetermined time elapse flag (step S22), and then, the procedure returns to the operation in step S21.

The predetermined time in the confirmation in step S21, for example, is experimentally or empirically determined based on attributes of information such as documents displayed on the display unit 106, probability of burn of the display unit 106, user convenience or the like.

As described above, according to the operation of the display apparatus D according to the embodiment, since display for preventing burn is performed when the detected display unit temperature is equal to or more than the threshold temperature, even in the case that the electrophoretic display medium in which burn is likely to be generated according to the display unit temperature is used in the display unit 106, deterioration in visibility due to burn can be effectively prevented.

Accordingly, even under the circumstances that the burn is likely to be generated, the display apparatus D having the non-volatile display medium of high power saving ability can maintain visibility, and has high applicability.

Further, since the burn prevention display is performed when the display unit temperature detected before the display change reaches the threshold temperature, the display unit temperature can be detected for every time of the display change to perform the burn prevention display, thereby effectively preventing burn.

In addition, since the display unit temperature is detected when the measured time from the timing of the display change on the display unit 106 reaches the predetermined time, and the burn prevention display is performed when the display unit temperature reaches the threshold temperature, the display unit temperature can be detected at the predetermined timing after the display change to perform the burn prevention display, thereby more effectively preventing burn.

Moreover, since the burn prevention display is performed when power supply to the display unit 106 is cut off, the measured time in the alarm timer 114 reaches the predetermined time, or when the display unit temperature reaches the threshold temperature, even in the case that the display content remains after the power supply for the display change on the electrophoretic display unit 106 is cut off, burn can be effectively prevented.

When turning off the power, since the time measurement in the alarm timer 114 is stopped after the burn prevention display is performed and the power supply for the display unit 106 is stopped, a unique power saving ability of the display apparatus D employing the electrophoretic display unit 106 can be further improved.

Further, since the content of the burn prevention display is experimentally determined, in consideration of the supposed cause of burn, based on the supposed highest temperature as the display unit temperature of the display apparatus D, the material of the particles which migrate in the microcapsule, the size of the microcapsule, the attributes of information which is frequently displayed on the display unit 106 (information indicating that the white color display is frequently performed, information indicating that the black color display is frequently performed), or the like, the burn-in of the display apparatus D can be more effectively prevented. Specifically, as the burn prevention display, it is preferable to perform a single color display such as a single color display in white or in black.

Further, in the above described embodiment, only when a display other than the burn prevention display is performed when the power supply for the display change for the display unit 106 is cut off, the time measurement by the alarm timer 114 may start at the timing. Accordingly, the unique power saving ability of the display apparatus D using the electrophoretic display unit 106 can be further improved.

Moreover, in the above described embodiment, only when the display unit temperature reaches the threshold temperature, the burn prevention display is performed. However, alternatively, a lowest temperature as the threshold temperature may be also set, and when the display unit temperature is outside of a temperature range between the threshold temperature which is the highest temperature and a threshold temperature which is the lowest temperature, the burn prevention display may be performed. With such a configuration, although burn is generated due to reduction in the display unit temperature as a characteristic of the non-volatile display medium, burn can be suppressed to a minimum.

In addition, in the above described embodiment, the invention is applied to the display apparatus D using the electrophoretic display unit 106, but the invention may be applied to a display apparatus D which includes a non-volatile display medium of other methods such as a so-called liquid crystal method or a chemical change method.

A program corresponding to the flowcharts described with reference to FIGS. 3 and 4A to 4F, or a program obtained through a network such as the Internet may be recorded in a recording medium of a flexible disc or the like, and then may be read and executed by a computer such as a microcomputer or the like, and thus, the microcomputer or the like may be served as the CPU 101 according to each embodiment.

As described above, the invention can be applied to an information display apparatus field, and particularly, to the information display apparatus field which uses the non-volatile display medium such as an electrophoretic display medium, thereby achieving remarkable advantages.

What is claimed is:

1. An information display apparatus comprising:

a display unit including a non-volatile display medium;

a temperature detecting unit configured to detect a display unit temperature which is temperature of the display unit;

a temperature determining unit configured to determine whether the display unit temperature is outside of a set temperature range which is predetermined based on characteristics of the display unit; a display control unit configured to perform on the display unit a burn prevention display which is predetermined based on the characteristics, when the display unit temperature is outside of the set temperature range, a timer unit configured to start measuring time from a change of a display on the display unit; and a time determining unit configured to determine whether the time measured by the timer unit exceeds a threshold time after the change, wherein the temperature detecting unit detects the display unit temperature if the measured time reaches the threshold time after the change, and wherein the display control unit performs the burn prevention display on the display unit when the detected display unit temperature is outside of the set temperature range.

2. The information display apparatus according to claim 1, wherein the temperature detecting unit detects the display unit temperature prior to a change of a display on the display unit, and wherein the display control unit performs the burn prevention display on the display unit when the display unit temperature is outside of the set temperature range before the change.

3. The information display apparatus according to claim 2, wherein the burn prevention display is performed prior to the change of the display but after an input requesting for the change.

4. The information display apparatus according to claim 1, wherein the display control unit displays the display unit with a single color as the burn prevention display.

5. The information display apparatus according to claim 4, wherein the display control unit displays the display unit with the single color in white as the burn prevention display.

6. An information display apparatus comprising:

a display unit including a non-volatile display medium;

a temperature detecting unit configured to detect a display unit temperature which is temperature of the display unit;

a temperature determining unit configured to determine whether the display unit temperature is outside of a set temperature range which is predetermined based on characteristics of the display unit;

a display control unit configured to perform on the display unit a burn prevention display which is predetermined based on the characteristics, when the display unit temperature is outside of the set temperature range;

a timer unit configured to start measuring time from when power supply for display change for the display unit is cut off; and a time determining unit configured to determine whether the time measured by the timer unit exceeds a threshold time after the power supply is cut off, wherein the temperature detecting unit detects the display unit temperature when the measured time reaches the threshold time after the power supply is cut off, and wherein the display control unit performs the burn prevention display on the display unit under a condition in which: the power supply to the display unit is cut off; the measured time reaches the threshold time after the power supply is cut off; and the detected display unit temperature is outside of the set temperature range.

7. The information display apparatus according to claim 6, wherein the timer unit starts, only when a display other than the burn prevention display is performed on the display unit at a timing when the power supply is cut off, the time measurement in the timing.

8. The information display apparatus according to claim 6, wherein the timer unit stops the time measurement after the burn prevention display is performed on the display unit by the display control unit, and thereafter the display control unit cuts off the power supply for the display unit.

9. A non-transitory computer readable medium having an information display program for an information display apparatus comprising a display unit including a non-volatile display medium, said program being stored thereon, readable by a computer, and when executed by the computer, causing the computer to perform operations comprising:

detecting a display unit temperature which is temperature of the display unit;

determining whether the display unit temperature is outside of a set temperature range which is predetermined based on characteristics of the display unit; and performing on the display unit a burn prevention display which is predetermined based on the characteristics, when the display unit temperature is outside of the set temperature range, measuring a time from a change of a display on the display unit; and determining whether the time measured exceeds a threshold time after the change, wherein the temperature of the display unit temperature is detected if the measured time reaches the threshold time after the change, and wherein the burn prevention display is performed on the display unit when the detected display unit temperature is outside of the set temperature range.

10. An information display apparatus comprising:

an electrophoretic display unit;

a temperature detecting unit configured to detect a display unit temperature which is temperature of the electrophoretic display unit;

a temperature determining unit configured to determine whether the display unit temperature is outside of a set temperature range which is predetermined based on characteristics of the electrophoretic display unit;

a display control unit configured to perform on the electrophoretic display unit a burn prevention display which is predetermined based on the characteristics, when the display unit temperature is outside of the set temperature range;

a timer unit configured to start measuring time from a predetermined time point; and a time determining unit configured to determine whether the time measured by the timer unit exceeds a threshold time after the predetermined time point, wherein the temperature detecting unit detects the display unit temperature if the measured time reaches the threshold time after the predetermined time point, and wherein the display control unit performs the burn prevention display on the electrophoretic display unit when the detected display unit temperature is outside of the set temperature range.

11. An information display apparatus comprising:

an electrophoretic display unit;

a temperature detecting unit configured to detect a display unit temperature which is temperature of the electrophoretic display unit;

a temperature determining unit configured to determine whether the display unit temperature is outside of a set temperature range which is predetermined based on characteristics of the electrophoretic display unit;

a display control unit configured to perform on the electrophoretic display unit a burn prevention display which is predetermined based on the characteristics, when the display unit temperature is outside of the set temperature range;

a timer unit configured to measure time from a change of a display on the electrophoretic display unit; and a time determining unit configured to determine whether the time measured by the timer unit exceeds a threshold time after the change, wherein the temperature detecting unit detects the display unit temperature if the measured time reaches the threshold time after the change, and wherein the display control unit performs the burn prevention display on the electrophoretic display unit when the detected display unit temperature is outside of the set temperature range.

12. An information display apparatus comprising:

an electrophoretic display unit;

a temperature detecting unit configured to detect a display unit temperature which is temperature of the electrophoretic display unit;

a temperature determining unit configured to determine whether the display unit temperature is outside of a set temperature range which is predetermined based on characteristics of the electrophoretic display unit;

a display control unit configured to perform on the electrophoretic display unit a burn prevention display which is predetermined based on the characteristics, when the display unit temperature is outside of the set temperature range;

a timer unit configured to measure time from when power supply for display change for the electrophoretic display unit is cut off; and a time determining unit configured to determine whether the time measured by the timer unit exceeds a threshold time after the power supply is cut off, wherein the temperature detecting unit detects the display unit temperature when the measured time reaches the threshold time after the power supply is cut off, and wherein the display control unit performs the burn prevention display on the electrophoretic display unit when: the power supply to the electrophoretic display unit is cut off;

the measured time reaches the threshold time after the power supply is cut off; and the detected display unit temperature is outside of the set temperature range.

* * * * *